US005499993A

United States Patent [19]

Blomdahl et al.

[11] Patent Number: 5,499,993

[45] Date of Patent: Mar. 19, 1996

[54] METHOD AND APPARATUS FOR PIERCING EARS

[75] Inventors: Karl Blomdahl; Pontus Andreasson, both of Göteborg, Sweden

[73] Assignee: Blomdahl Medical Aktiebolag, Halmstad, Sweden

[21] Appl. No.: 64,143

[22] PCT Filed: Nov. 27, 1990

[86] PCT No.: PCT/SE90/02033

§ 371 Date: May 6, 1994

§ 102(e) Date: May 6, 1994

[87] PCT Pub. No.: WO92/09219

PCT Pub. Date: Jun. 11, 1992

[51] Int. Cl.[6] ..... A61B 17/34

[52] U.S. Cl. ..... 606/188

[58] Field of Search ..... 606/117, 185, 606/188; 227/67, 73

[56] References Cited

U.S. PATENT DOCUMENTS

| | | | |
|---|---|---|---|
| 3,943,935 | 3/1976 | Cameron . | |
| 4,030,507 | 6/1977 | Mann . | |
| 4,527,563 | 7/1985 | Reil . | |
| 4,860,747 | 8/1989 | Sciara | 606/188 |
| 4,931,060 | 6/1990 | Aué | 606/188 |
| 5,211,653 | 5/1993 | Nakajima | 606/188 |

FOREIGN PATENT DOCUMENTS

| | | | |
|---|---|---|---|
| 1247653 | 9/1971 | United Kingdom | 606/188 |
| 2142538 | 6/1983 | United Kingdom . | |
| 2135171 | 8/1984 | United Kingdom | 606/188 |
| 2187960 | 2/1986 | United Kingdom . | |

*Primary Examiner*—Stephen C. Pellegrino
*Assistant Examiner*—William W. Lewis

[57] ABSTRACT

An ear piercing apparatus is disclosed which comprises a pistol (1) and a disposable cassette (20) mounted on said pistol, the pistol (1) having a body portion (10), a handgrip (11), a spring biased plunger (12) and means for releasing said plunger from a cocked state, with said disposable cassette (20) comprising a stud housing (22) positioned adjacent said body portion (10) for cooperation with said plunger (12) and a back clasp housing (23) cooperating with the stud housing (22) via a guide member (33) extending from the back clasp housing (23) and passing into the stud housing (22) for cooperation with positioning means controlled by a positioning lever (38) on said pistol (1) for relative axial displacement of the stud housing (22) and the back clasp housing (23). So as to reduce the risk of infection to the patient and to the operator from residual body fluid secretion, the positioning means in said apparatus engages with said guide member (33) at a location within said stud housing (22) so that no part of said positioning means or said pistol extends beyond said stud housing (22).

18 Claims, 3 Drawing Sheets

METHOD AND APPARATUS FOR PIERCING EARS

FIELD OF THE INVENTION

The present invention relates to an apparatus for piercing ears comprising a pistol and a disposable cassette mounted on said pistol, the pistol having a body portion, a handgrip, a spring biased plunger and means for releasing said plunger from a cocked state, with said disposable cassette comprising a stud housing positioned adjacent said body portion for cooperation with said plunger and a back clasp housing cooperating with the stud housing via a guide member extending from the back clasp housing and passing into the stud housing and cooperating with a positioning means controlled by a positioning lever on said pistol for relative axial displacement of the stud housing and the back clasp housing.

The invention also relates to a disposable cassette assembly for use in the apparatus of the type described above, comprising a cassette having a stud housing and a back clasp housing cooperating with said stud housing via a guide member extending from the back clasp housing and passing into the stud housing.

The invention also relates to a method for piercing an ear lobe with a stud which engages a clasp, in which a disposable cassette comprising a stud housing and a back clasp housing is mounted on a pistol, the pistol then being operated to eject the stud from its housing to penetrate the ear lobe and to engage said clasp, the spent cassette and pistol thereafter being withdrawn from the vicinity of the ear lobe and the cassette being removed from the pistol and discarded.

DESCRIPTION OF THE BACKGROUND ART

Since during the ear-piercing operation the patient's skin is penetrated, hygiene and sterility is of the utmost importance. For this reason, pre-packed cassette systems have become increasingly popular. In such a system, the stud which is to pierce the ear and the clasp which then holds the stud in the ear are mounted in disposable plastic holders so that these holders can be mounted on the applicator, normally a pistol, without the stud and clasp themselves being touched by the operator. After use, the holders are discarded.

During piercing there is very often a secretion of body fluid from the earlobe. Should this fluid contact the applicator, there is a risk of cross-infection for the next patients to be treated. This problem has been addressed in GB-A-2 187 960 which discloses an ear piercing gun in which a disposable cassette or cartridge comprising a cooperating stud holder and clasp holder is mounted on a support formed integrally with the trigger of the gun. Whilst the disposable cassette covers the upper surface of the support, the side surfaces of the support are exposed, as is the gun body itself.

From GB-A-2 142 538 an ear piercing apparatus is known in which the stud is mounted in a cassette having a cover portion which covers the body of the applicator in the region of the stud. However, in this case the support arm for the clasp holder is fully exposed and can easily come into contact with the patient's earlobe.

Danger of infection exists not only for the patient, but also for the operator of the apparatus should the operator come into contact with any secretion on the applicator or the cassette itself.

SUMMARY OF THE PRESENT INVENTION

It is an object of the present invention to provide an ear piercing apparatus, a disposable cassette assembly and a method for piercing an ear lobe in which the risk of infection for both the patient and the operator is significantly reduced.

This object is attained according to the present invention by an ear piercing apparatus which is characterized in that said positioning means engages with said guide member at a location within said stud housing so that no part of said positioning means or said pistol extends beyond said stud housing.

Since no part of the positioning means or the pistol extends beyond the stud housing, the patient's earlobe can only come into contact with the disposable, sterile cassette. Similarly, since the positioning means is located within the stud housing, there is no danger of contact with any possible secretions.

Preferably, the disposable cassette is mounted on the pistol by means of an overlap portion on the stud housing covering a portion of a pistol body. Thus, the pistol body is also protected from any secretions.

Conveniently, said overlap portion is provided with ribs for engagement with grooves in the body of the pistol, or vice versa.

Advantageously the pistol is provided with blocking means to prevent actuation of the cocked plunger when the positioning means is not fully retracted.

The disposable cassette assembly for use in the apparatus as described above is characterized in that the cassette assembly further comprises a removable cover which envelops said cassette on all but two open sides, thereby allowing the cassette assembly to be handled by an operator without the operator having to contact said cassette.

Preferably, the cover is provided with means for maintaining the stud housing and the back clasp housing in just one position relative to each other. This permits accurate engagement of the cassette on the pistol body and on the positioning means.

In order to facilitate the removal of the cover, the cover is advantageously provided with externally directed flanges adjacent one of said open sides.

Conveniently, said back clasp housing is provided with two adjacent, cooperating, parallel slots for receiving then locating a back clasp, such that the outer slot is of slightly greater width than the diameter of the back clasp whilst the inner slot is of substantially the same width as the back clasp diameter.

In addition, a slot may be provided in a rear wall of the back clasp housing, which slot cooperates with the outer slot and which acts as a guide for a projection on the rear of said clasp.

For ease of assembly it is advantageous if said projection of the rear of said clasp is flush with said rear wall of the back clasp housing when said clasp is held in the inner slot.

The guide member may be provided with a tapered shoulder at its end remote from the stud housing, which shoulder cooperates with the tapered surface on an opening in said stud housing through which the guide member passes. This enables the stud and the clasp to be highly accurately aligned before the piercing takes place.

Advantageously, the stud housing is provided with a substantially cylindrical shaped tube to accomodate a stud, said tube having an inner surface with regions of differing diameter, a first region furthest from said back clasp housing having a diameter sufficient to hold the stud before being fired, a second region adjacent said first region of slightly larger diameter to guide said stud whilst passing within the tube, and a third region of yet greater diameter wherein no contact occurs between the stud and the inner surface.

The method of piercing an ear lobe according to the present invention is characterized in that the cassette is provided with a removable cover which is used to mount the cassette on the pistol, the cover then being removed to allow the pistol to be operated and thereafter being replaced to allow removal of the cassette from the pistol without the operator having to contact the cassette itself. Thus, the operator never has to touch any part of the cassette or pistol which may have been contaminated with body fluid secretion.

Further advantages of the present invention will become apparent from the following description of specific embodiments of the invention made by way of example only and with reference to the accompanying drawings.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
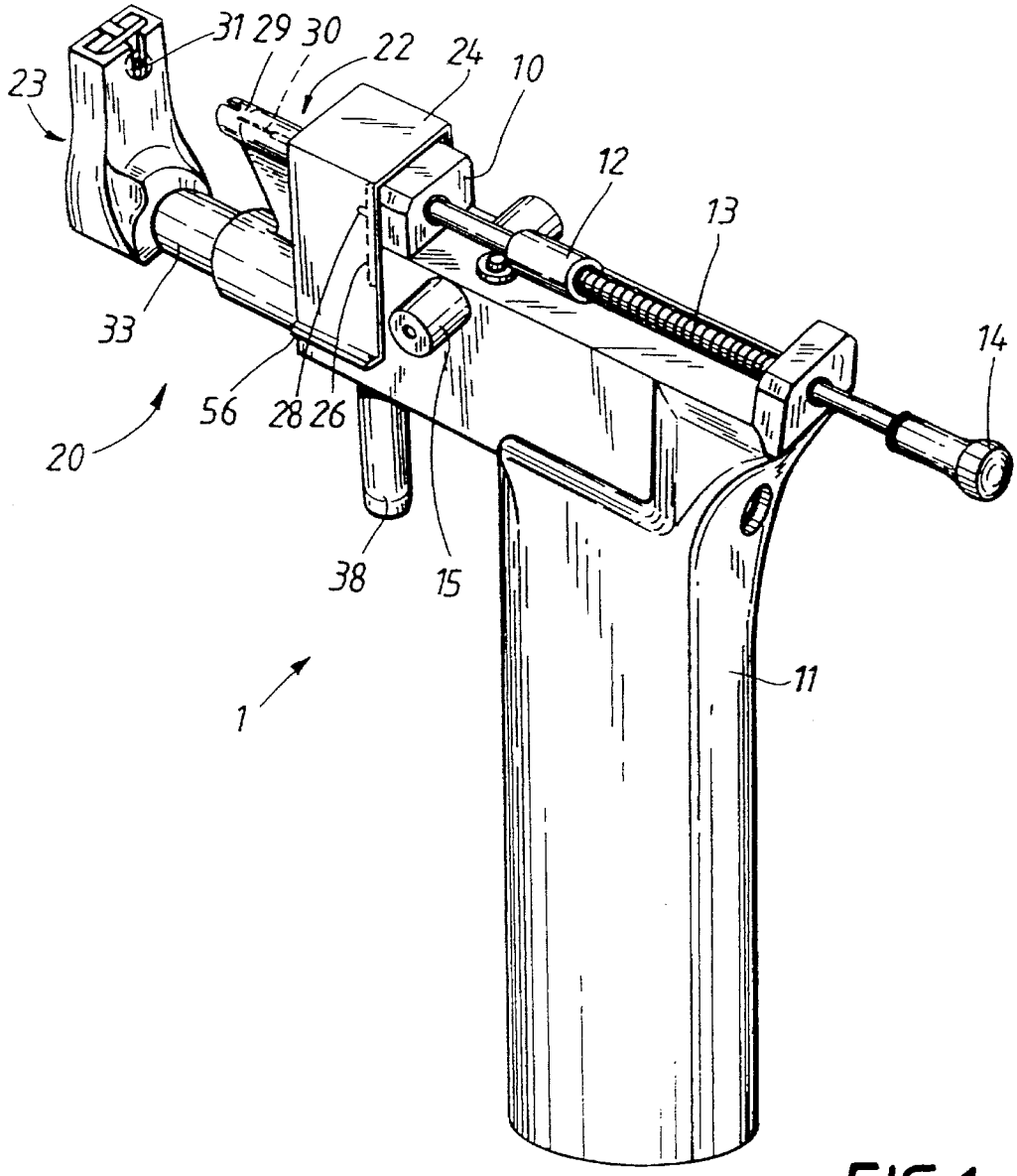
FIG. 1 is a perspective view of an ear piercing apparatus according to the present invention.

As shown in FIG. 1, the ear piercing apparatus according to the present invention comprises a pistol 1 and a disposable cassette 20. The pistol 1 has a body portion 10, a handgrip 11 and a plunger 12 biased by a spring 13. A toggle 14 is provided on the end of the plunger 12 remote from the cassette 20 to allow the plunger to be manually drawn to the right as shown in FIG. 1 against the bias of the spring 13 in order to bring the pistol to its loaded or cocked position. A trigger 15 allows the cocked plunger 12 to be released.

Once the pistol is in its loaded position as shown in FIG. 1, the disposable cassette 20 may be engaged with the pistol.

The cassette comprises two principal constructional elements, that is a stud housing 22 and a back clasp housing 23. These parts may be made of plastics or other suitable material. The stud housing 22 and the back clasp housing 23 are shown in their assembled state.

The stud housing 22 has an overlap portion 24 for covering a part of the pistol body 10 when in the mounted state. As best can be seen from FIGS. 1 and 2, engaging means comprising ribs 25 in the overlap portion 24 cooperate with complimentary grooves 26 in the body of the pistol 10. The ribs 25 are provided with projections 27 which engage with complimentary recesses 28 in the grooves 26 in the pistol body 10. Naturally, the ribs may, instead, be provided on the pistol body, whilst the grooves are formed in the overlap portion.

A substantially cylindrical-shaped tube 29 on the stud housing 22 accommodates a stud 30 for penetrating, not shown, earlobe, not shown.

Figure 4:
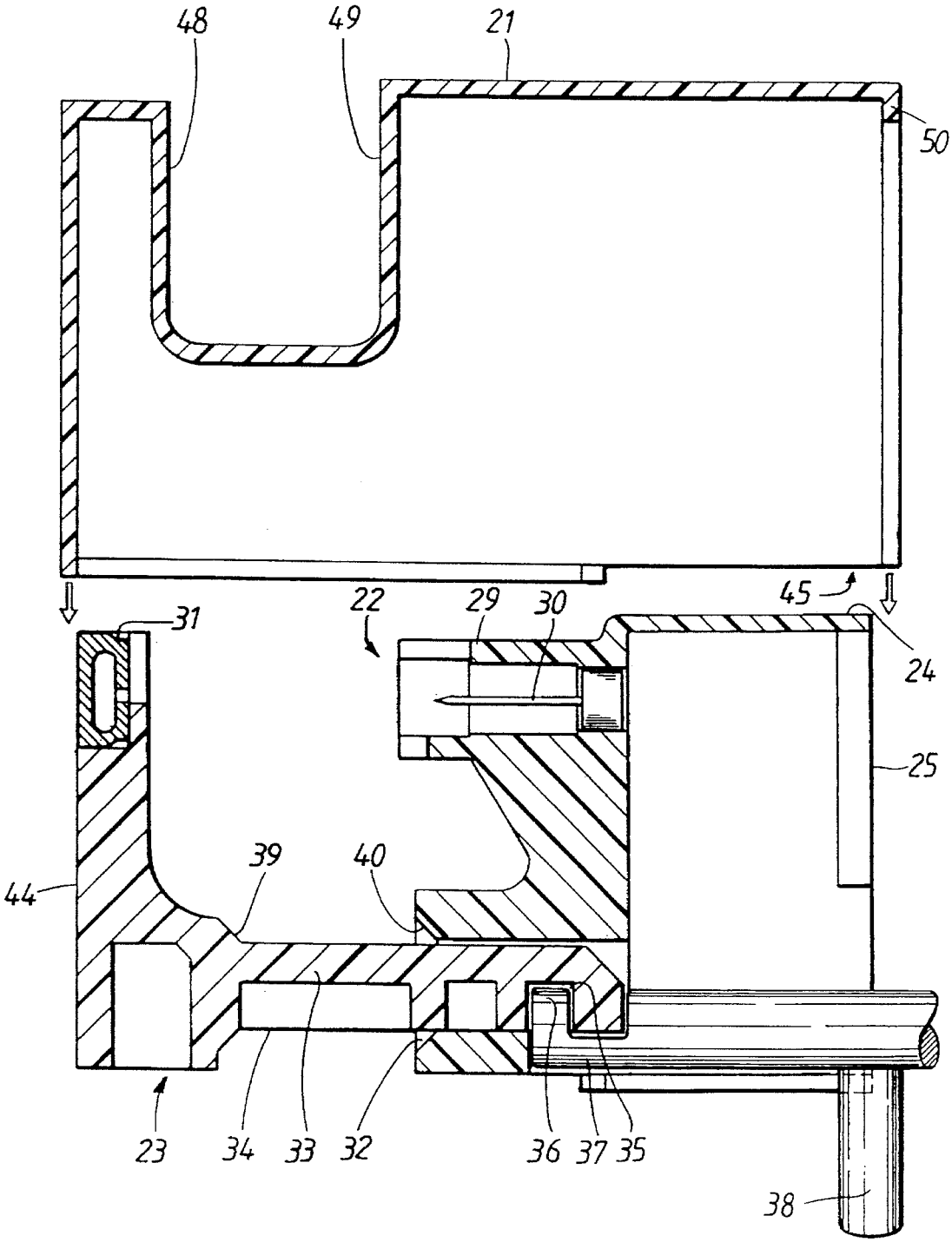
FIG. 4 is a sectional view of the disposable cassette and cover.

Before being fired, the stud is held in a region of said cylindrical-shaped tube of a first diameter, as shown in FIG. 4. Adjacent this region is a region of slightly larger diameter which acts as a guide passage for the stud as the stud passes through the tube. Finally, a region of greater diameter is provided before the stud exits the tube 29, in which region no contact occurs between the stud and the tube.

In order to accurately align a back clasp 31 with said stud 30, a through opening 32 is provided in the stud housing 22 for the receival of a projecting guide member 33 on the back clasp housing 33.

The through opening 32 and guide member 33 are shown in the figures as having a semi-circular cross-section, though naturally other shaped cross-sections could also be used. The flat surface 34 of the semi-circular guide member 33 is provided with a recess 35 (FIG. 4) which cooperates with a projection 36 on an arm 37 forming a part of positioning means controlled by a positioning lever 38 on the pistol body 10 as shown in FIG. 1.

The guide member 33 is provided with a tapered shoulder 39 at its end remote from the stud housing 22. The through opening 32 in the stud housing 22 is correspondingly provided with a cooperating taper 40 on its entry surface.

Furthermore, the leading edge of the guide member is also provided with a tapered region to facilitate the entry of the guide member into the body portion 10 of the pistol.

Figure 3:
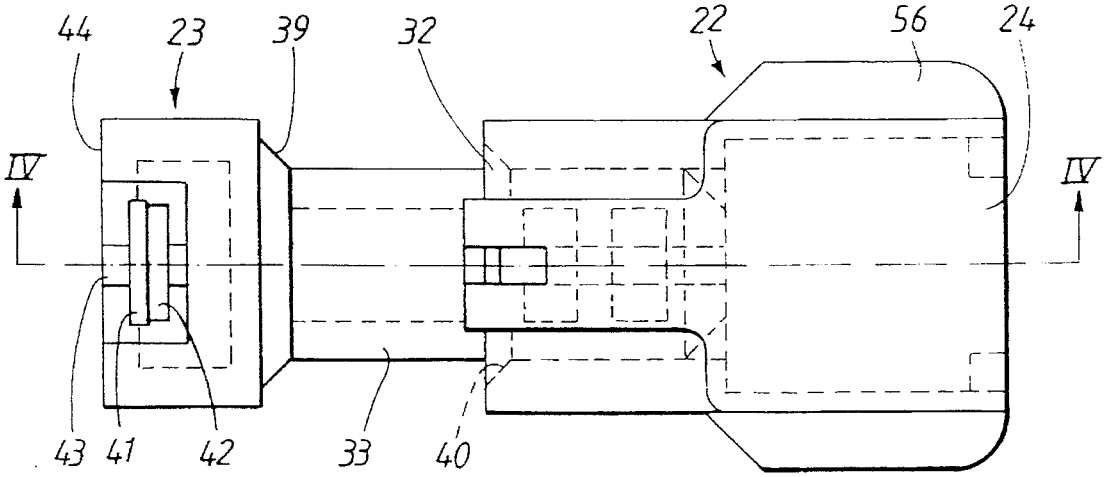
FIG. 3 is a plan view of a suitable disposable cassette.

The back clasp 31 is accommodated in the upper part of the housing 23. As can best be seen from FIGS. 3 and 4, two parallel slots 41, 42 are formed transverse to the line of action of the stud 30. The slots 41, 42 are open at the top and are of sufficient depth to ensure that the back clasp is centrally aligned with the stud 30. The outer slot 41 is of slightly greater width than the diameter of the back clasp 31 to allow unrestricted entry of the clasp during assembly of the cassette before customer delivery. To aid introduction of the clasp 31 in housing 23, a slot 43 which cooperates with the outer slot 41 is provided in the rear wall 44 of the housing 23. A projection on the rear on the clasp 31 is guided by the slot 43 so as to ensure accurate alignment of the clasp 31 with the stud 30. Once the clasp is in the housing, the projection is depressed to force the clasp 31 into the inner slot 42 of the housing 23 wherein the clasp is held by friction from contact between the transverse edges of the slot 42 and the circumference of the clasp. In this position, the projection is flush with the rear wall 44 of the housing 23. The depth of the slots 41, 42 substantially corresponds with the length of the projection on the rear of the clasp 41, so that the top of the projection is flush with the top of the back clasp housing 23.

In the disposable cassette assembly according to the invention, a removable cover 21 is provided for the cassette 20. The cassette 20, along with its removable cover 21, is prepacked for example in a sterile blisterpack (not shown). Once removed from the packing, the cassette and cover assembly has an outward appearance as best shown in FIG. 2.

Figure 2:
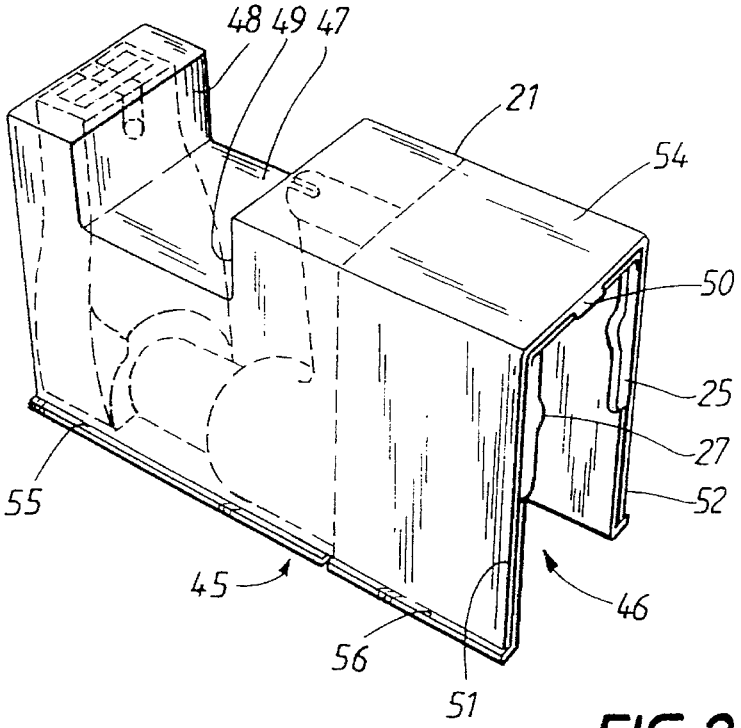
FIG. 2 is a perspective view of disposable cassette and cover for use in the apparatus according to the invention.

The removable cover 21 is generally rectangular shaped, having two fully open sides 45, 46 which allow the stud housing 22 and back clasp housing 23 to be introduced and removed via the lower open side 45 as shown in FIG. 2 and further to allow the stud housing 22 to be attached to the pistol body 10 via the end open side 46 whilst the cover 21 is still in situ.

As can best be seen from FIGS. 2 and 4, the cover 21 is further provided with an inwardly projecting section 47 comprising parallel faces 48, 49 whose spacing determines the spacing between the stud housing 22 and the back clasp housing 23. A projection 50 on the inner surface of the upper wall 54 of the cover 21 acts as an abutment against the end of the stud housing 22 remote from the back clasp housing 23. The faces 48, 49 and the projection 50 act so as to permit the fitting of the cover 21 over the stud housing 22 and back clasp housing 23 in only one possible position, as best shown in FIG. 4.

The cover is manufactured from a resilient material such that the major side walls 51, 52 of the cover taper slightly towards each other away from the upper wall 54. The resiliency of the side walls 51, 52 allows the cover to be slipped over the cassette 20 and maintained there due to friction between the respective contacting surfaces.

The mode of operation of the ear piercing apparatus will now be described.

Whilst holding the handgrip 11 of the pistol 1 in one hand, the operator withdraws the plunger 12 with the other hand. The pistol is now in its loaded or cocked state.

The cassette and cover assembly is removed from its preferably sterile packaging. It should be noted that the operator should only handle the cover 21 of the assembly. The assembly is then slipped over the end part of the pistol 10 so that the ribs 25 and projections 27 on the stud housing 22 engage with the complimentary grooves 26 and recesses 28 in the pistol body 10.

Since the cover 21 maintains the stud housing 22 and the back clasp housing 23 in only one possible position, the recess 35 in the guide member 33 of the clasp housing is automatically aligned with the projection 36 on the arm 37 of the positioning means on the pistol (FIG. 4).

Once the cassette has positively engaged with the pistol, the cover 21 can be removed with the aid of flanges 55 adjacent its lower open side 45. An earlobe can now be placed in the gap between the stud housing 22 and the back clasp housing 23.

In order to securely hold the earlobe with respect to the stud housing and clasp housing, the operator gently squeezes the positioning lever 38 towards the handgrip 11 until the tapered shoulder 39 on the guide member 33 abuts the cooperating taper 40 on the entry surface of the through opening 32. The cooperation of these two surfaces effectively eliminates any lateral play in the cassette between the guide member 33 and the through opening 32.

Due to a not shown blocking mechanism, the plunger 12 cannot be released by the trigger 15 until the positioning lever 38 is fully retracted, i.e. the trigger cannot be fired unless the earlobe is securely held between the stud housing and the back clasp housing. Provided this condition is met, the trigger 15 is operated and the stud 30 is forced through the earlobe and into engagement with the clasp 31.

The force of the impact of the stud 30 with the clasp 31 displaces the clasp from the locating (inner) slot 42 into the outer slot 41 of the back clasp housing 23. Thus, the clasp may be removed from the housing by vertical downward displacement of the ear piercing apparatus, thereby leaving the stud and clasp in the earlobe.

Cover 21 is now replaced over the cassette 20. Plunger 12 is withdrawn to the cocked position and the combined cover and cassette assembly is removed from the pistol with the aid of flanges 56 on the base of the overlap portion 24 of the stud housing 22.

The cover and cassette assembly can now be discarded without the operator ever having to handle the cassette itself.

Naturally, the invention is not restricted to the above described embodiment, but may be varied within the scope of the appended claims. For example, two triggers may be provided, one on each side of the pistol, so that the pistol may be used by a left-handed or a right-handed person. Furthermore, the engaging means on the stud housing need not comprise ribs and projections, but can be provided by some sort of clasp means.

Whilst the invention has been described in connection with the piercing of an ear lobe, it is to be understood that the claimed apparatus, cassette assembly and method may be employed for piercing any part of the body, such as the nose or the ear itself.

We claim:

1. An ear piercing apparatus, comprising:

a pistol and a disposable cassette mounted on said pistol, said pistol including:

a body portion;

a handgrip extending from said body portion;

a spring-biased plunger adapted for displacement on said body portion from a cocked position to a released position;

means for releasing said plunger from said cocked position;

positioning means, including an arm extending from said body portion for engagement with a part of said disposable cassette;

a positioning lever extending from said body portion for displacing said positioning means;

said disposable cassette including:

a stud housing positioned adjacent said pistol body portion for cooperation with said spring-biased plunger, and a back clasp housing cooperating with the stud housing via a guide member extending from said back clasp housing;

wherein said guide member passes through an opening in the stud housing and cooperates with said positioning means controlled by said positioning lever on said pistol for relative axial displacement of the stud housing and the back clasp housing, with said positioning means engaging with said guide member at a location within said stud housing so that no part of said positioning means or said pistol extends beyond said stud housing.

2. The ear piercing apparatus as claimed in claim 1, wherein the disposable cassette is mounted on the pistol by means of an overlap portion on the stud housing covering a portion of the pistol body.

3. The ear piercing apparatus as claimed in claim 2, wherein said overlap portion is provided with ribs for engagement with grooves in the body of the pistol.

4. The ear piercing apparatus as claimed in claim 1, wherein said positioning means is adapted to adopt a fully retracted state in which said back clasp housing and said stud housing lie in proximity to each other, said pistol being provided with blocking means to prevent actuation of the cocked plunger when the positioning means is not in said fully retracted state.

5. The ear piercing apparatus as claimed in claim 2, wherein said positioning means is adapted to adopt a fully retracted state in which said back clasp housing and said stud housing lie in proximity to each other, said pistol being provided with blocking means to prevent actuation of the cocked plunger when the positioning means is not in said fully retracted state.

6. A disposable cassette assembly for use with an ear piercing pistol, comprising:

a cassette having a stud housing and a back clasp housing cooperating with said stud housing via a guide member extending from the back clasp housing and passing into the stud housing, and a removable cover which envelops said cassette on all but two open sides, thereby allowing the cassette assembly to be attached to and removed from the pistol by an operator without the operator having to contact said cassette.

7. The disposable cassette assembly as claimed in claim 6, wherein the cover is provided with means for maintaining the stud housing and the back clasp housing in just one position relative to each other.

8. The disposable cassette assembly as claimed in claim 6, wherein said cover is provided with externally directed flanges adjacent one of said open sides.

9. The disposable cassette assembly as claimed in claim 7, wherein said cover is provided with externally directed flanges adjacent one of said open sides.

10. The disposable cassette assembly as claimed in claim 6, wherein said back clasp housing is provided with two adjacent, cooperating, parallel slots for receiving then locating a back clasp, such that an outer slot is of slightly greater width than a diameter of the back clasp whilst an inner slot is of substantially a same width as a back clasp diameter.

11. The disposable cassette assembly as claimed in claim 10, wherein a slot is provided in a rear wall of the back clasp housing, said slot cooperates with the outer slot and acts as a guide for a projection on a rear of said clasp.

12. The disposable cassette assembly as claimed in claim 10, wherein when said clasp is held in the inner slot, said projection on the rear of said clasp is flush with said rear wall of the back clasp housing.

13. The disposable cassette assembly as claimed in claim 11, wherein when said clasp is held in the inner slot, said projection on the rear of said clasp is flush with said rear wall of the back clasp housing.

14. The disposable cassette assembly as claimed in claim 6, wherein said guide member is provided with a tapered shoulder at an end remote from the stud housing, said shoulder cooperates with a tapered surface on said opening in said stud housing through which the guide member passes.

15. The disposable cassette assembly as claimed in claim 10, wherein said guide member is provided with a tapered shoulder at an end remote from the stud housing, said shoulder cooperates with a tapered surface on said opening in said stud housing through which the guide member passes.

16. The disposable cassette assembly as claimed in claim 6, wherein said stud housing is provided with a substantially cylindrical-shaped tube to accommodate a stud, said tube having an inner surface with regions of differing diameter, a first region furthest from said back clasp housing has a diameter sufficient to hold the stud before being fired, a second region adjacent said first region has a slightly larger diameter to guide said stud whilst passing within the tube, and a third region of yet greater diameter wherein no contact occurs between the stud and the inner surface.

17. The disposable cassette assembly as claimed in claim 10, wherein said stud housing is provided with a substantially cylindrical-shaped tube to accommodate a stud, said tube having an inner surface with regions of differing diameter, a first region furthest from said back clasp housing has a diameter sufficient to hold the stud before being fired, a second region adjacent said first region has a slightly larger diameter to guide said stud whilst passing within the tube, and a third region of yet greater diameter wherein no contact occurs between the stud and the inner surface.

18. A method for piercing an ear lobe with a stud which engages a clasp, said method comprising the steps of:

mounting a disposable cassette comprising a stud housing, a back clasp housing and a removable cover on a pistol, wherein said removable cover is used to mount the cassette on the pistol;

removing the cover to allow the pistol to be operated to eject the stud from the stud housing to penetrate the ear lobe and to engage said clasp held in said back clasp housing;

withdrawing said cassette and said pistol from a vicinity of the ear lobe;

replacing the removable cover on the cassette;

removing the cassette from the pistol by gripping said removable cover; and discarding the cassette, thereby ensuring that the operator does not come into contact with the cassette itself.

* * * * *

UNITED STATES PATENT AND TRADEMARK OFFICE

CERTIFICATE OF CORRECTION

PATENT NO. : 5,499,993

DATED : March 19, 1996

INVENTOR(S) : Blomdahl et al

It is certified that error appears in the above-identified patent and that said Letters Patent is hereby corrected as shown below:

On the Title Page, under the Heading, [86] PCT No.:, change

"PCT/SE90/02033" to --PCT/EP90/02033--

Signed and Sealed this

Twenty-third Day of July, 1996

*Attest:*

*Attesting Officer*

Bruce Lehman

BRUCE LEHMAN

*Commissioner of Patents and Trademarks*